US007438077B1

(12) United States Patent
Wilson

(10) Patent No.: US 7,438,077 B1
(45) Date of Patent: Oct. 21, 2008

(54) SLEEVE-ACTUATED UMBRELLA

(76) Inventor: Robert J. Wilson, 136 Woodhaven Cir., Holmen, GA (US) 30606

( * ) Notice: Subject to any disclaimer, the term of this patent is extended or adjusted under 35 U.S.C. 154(b) by 0 days.

(21) Appl. No.: 11/891,396

(22) Filed: Aug. 10, 2007

(51) Int. Cl.
*A45B 25/14* (2006.01)
*A45B 17/00* (2006.01)

(52) U.S. Cl. ..... 135/20.3; 135/39; 135/20.1

(58) Field of Classification Search ..... 135/15.1, 135/20.3, 25.1, 25.4, 37, 38, 39, 41, 98, 20.1, 135/27
See application file for complete search history.

(56) References Cited

U.S. PATENT DOCUMENTS

| | | | | | |
|---|---|---|---|---|---|
| 1,180,145 | A | | 4/1916 | Hart | |
| 1,273,861 | A | | 7/1918 | Howard | |
| 2,822,815 | A | | 2/1958 | Bremshey | |
| 4,000,750 | A | * | 1/1977 | Becher | 135/16 |
| 4,424,824 | A | * | 1/1984 | Becher | 135/20.3 |
| 4,813,442 | A | * | 3/1989 | Haines | 135/98 |
| 5,046,518 | A | | 9/1991 | Chang | |
| 5,069,237 | A | | 12/1991 | Flanagan | |
| 5,184,639 | A | | 2/1993 | Lee | |
| 5,253,666 | A | | 10/1993 | Huang | |
| 5,284,171 | A | | 2/1994 | Liu | |
| 5,329,953 | A | | 7/1994 | Becher | |
| 5,588,455 | A | * | 12/1996 | Kuo | 135/28 |
| 5,711,333 | A | * | 1/1998 | Vanderminden, Sr. | 135/20.3 |
| 5,752,534 | A | * | 5/1998 | Becher | 135/15.1 |
| 6,058,951 | A | | 5/2000 | Wilson | |
| 6,082,383 | A | | 7/2000 | Wilson | |
| 6,571,813 | B2 | * | 6/2003 | Lin et al. | 135/28 |
| 2005/0045217 | A1 | * | 3/2005 | Clarke | 135/20.3 |
| 2006/0090784 | A1 | * | 5/2006 | Ma | 135/98 |
| 2006/0151018 | A1 | * | 7/2006 | Wilson | 135/16 |

* cited by examiner

*Primary Examiner*—David R Dunn
*Assistant Examiner*—Patrick D Lynch
(74) *Attorney, Agent, or Firm*—Robert J. Harter

(57) ABSTRACT

An umbrella has an intermediate point of equilibrium between its fully open and closed positions, which reduces the peak force required to move the umbrella in either direction. To actuate the umbrella, a resiliently flexible steel band is able to not only carry tension to pull the umbrella open, but the band also has sufficient rigidity to operate in compression to push the umbrella closed. The band's flexibility allows it to feed through a small sidewall hole in the mast as well as snake through a hinge on an umbrella mast that can tilt. Manually sliding an actuator sleeve upward closes the umbrella. Sliding the sleeve down opens the umbrella. Although lifting to close and lowering to open may seem counterintuitive at first, such action greatly reduces the maximum force required to operate the umbrella.

11 Claims, 5 Drawing Sheets

SLEEVE-ACTUATED UMBRELLA

FIELD OF THE INVENTION

The subject invention generally pertains to umbrellas more specifically to an actuator for an umbrella.

BACKGROUND OF RELATED ART

Patio style umbrellas that are particularly large can be difficult to operate due to the substantial force needed to raise the relatively heavy canopy to an open position. A crank and gear reduction mechanism can be used to reduce the force, but such manual mechanisms can be tedious to use due to the time it takes to crank the umbrella open and closed. The cranking action can also apply an undesirable rotational moment on the umbrella's mast, wherein the rotational moment urges the canopy to twirl back and forth with each revolution of the crank.

As an alternative, U.S. Pat. No. 6,058,951 discloses a motor powered umbrella where a motorized mechanism pulls on a set of spokes or linkage that lifts the canopy to its open, raised position. As explained in column 3, lines 46-48 of the '951 patent, the weight of the canopy can later be used in returning the umbrella back down to its closed position. The motorized mechanism, of course, requires a source of electrical power that, unfortunately, might not always be readily available.

Another alternate design is disclosed in U.S. Pat. No. 6,082,383. Instead of purely raising the entire canopy to the open position, the canopy's outer perimeter rises while a central portion actually descends. This reduces the total distance that the umbrella's center of gravity must travel, thus reducing the energy and force required to operate the umbrella. This design, unfortunately, requires a long slot (item 22 of the '383 patent) in the umbrella's mast, and such a slot is not easily manufacturable by high production means. Moreover, such a slot can weaken the mast.

Consequently, there still is a need for an umbrella actuator that overcomes the drawbacks of existing mechanisms.

SUMMARY OF THE INVENTION

It is an object of the present invention to provide an umbrella with an actuator that is relatively inexpensive and easy to operate.

Another object of some embodiments is to provide an umbrella actuator with a elongate member that is sufficiently flexible to snake through a side hole of a tubular mast yet is sufficiently stiff to forcibly push an umbrella to a closed position.

Another object of some embodiments is to provide a push-and-pull elongate member that can feed through the hinge of a pivotal umbrella mast.

Another object of some embodiments is to provide an umbrella having a center of gravity that is at its lowest position when the umbrella is partially open, thus gravity force alone is insufficient to totally move the umbrella between its fully open and fully closed positions.

Another object of some embodiments is to avoid weakening an umbrella's tubular mast with a long slot.

Another object of some embodiments is to provide an umbrella actuator with a flexible elongate member that is more flexible in one direction than another.

Another object of some embodiments is to provide an umbrella actuator with a flexible elongate member that is completely sheltered and hidden from view regardless of whether the umbrella is open or closed.

Another object of some embodiments is to provide an umbrella with a button-release sleeve that makes it easier to release the umbrella from its open position.

One or more of these and/or other objects of the invention are provided by an umbrella actuator that includes a resiliently flexible elongate member that exerts a pushing force to close the umbrella and a pulling force to open it.

DESCRIPTION OF THE PREFERRED EMBODIMENT

Figure 1:
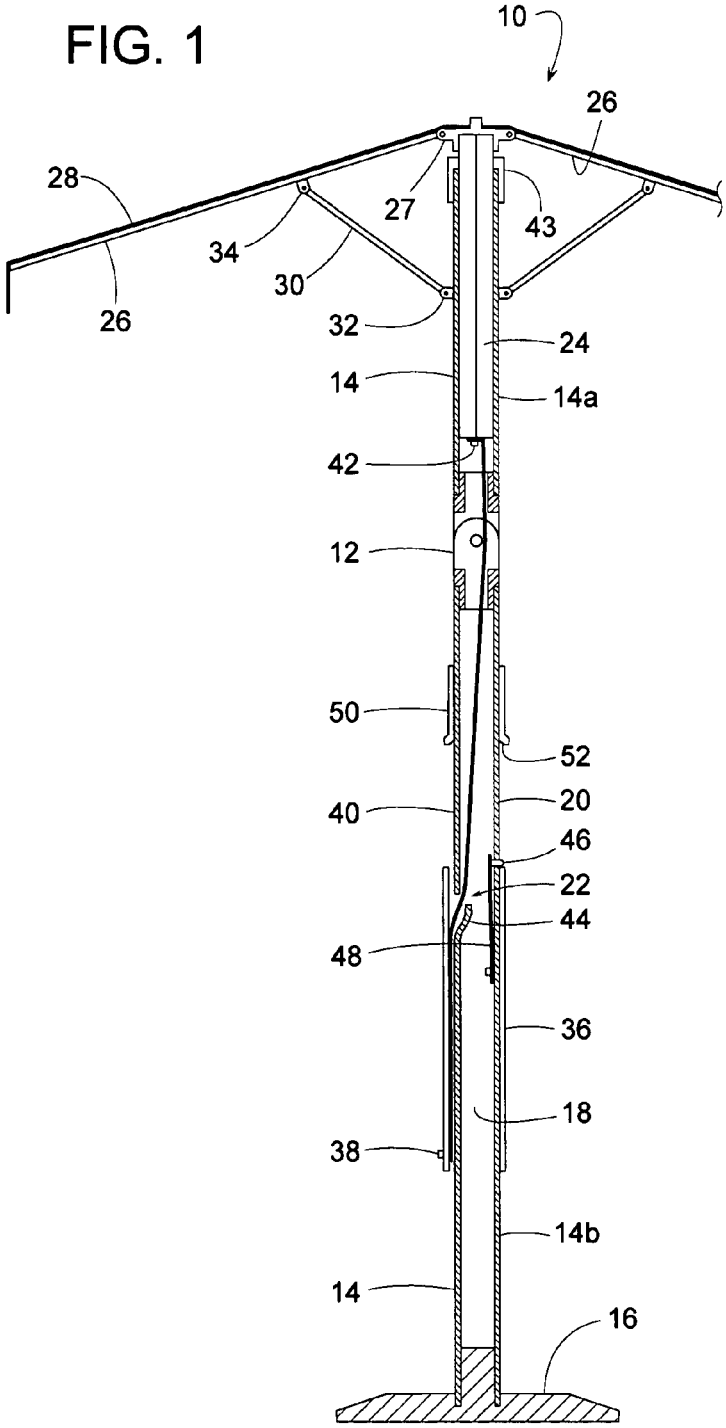
FIG. 1 is a cross-sectional side view of a fully open umbrella, wherein a portion of the umbrella is cut a way.
Figure 2:
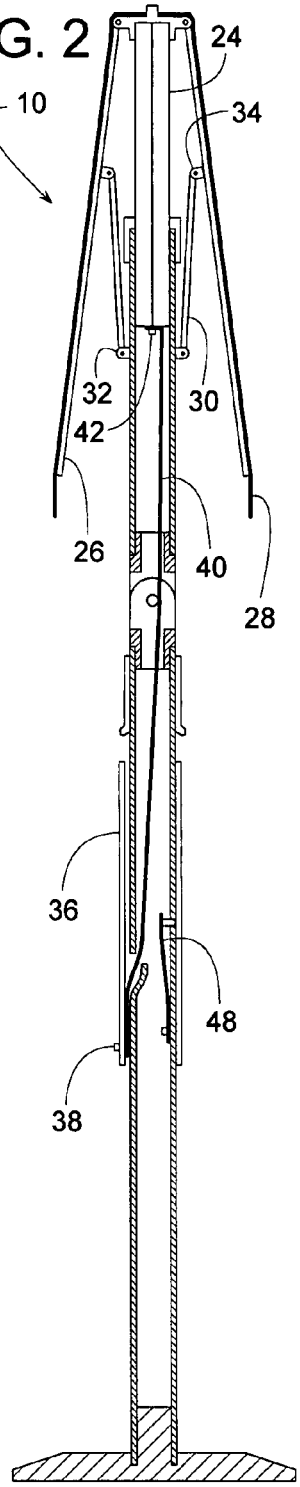
FIG. 2 is a cross-sectional view similar to FIG. 1 but with the umbrella shown in the fully closed position.
Figure 5:
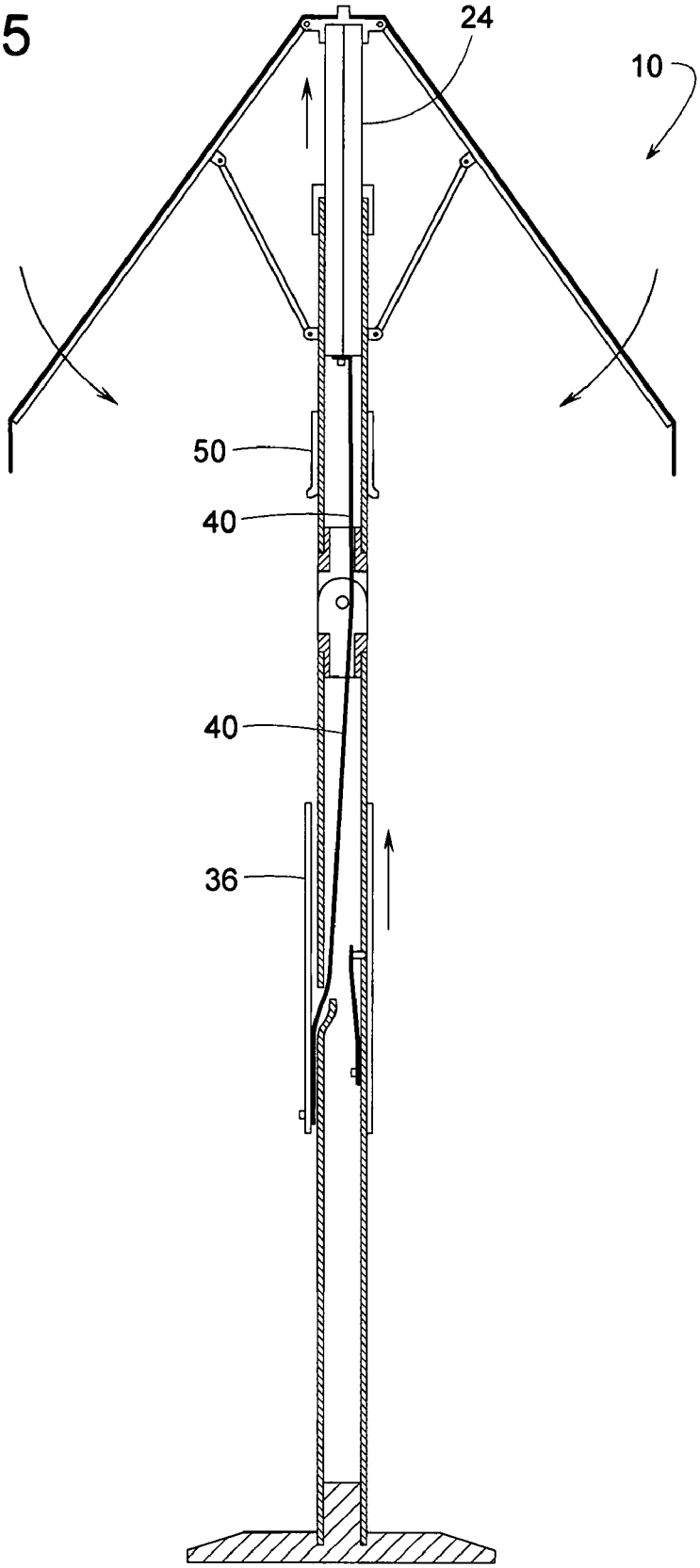
FIG. 5 is a cross-sectional side view of the umbrella shown at an intermediate force-equilibrium position.
Figure 6:
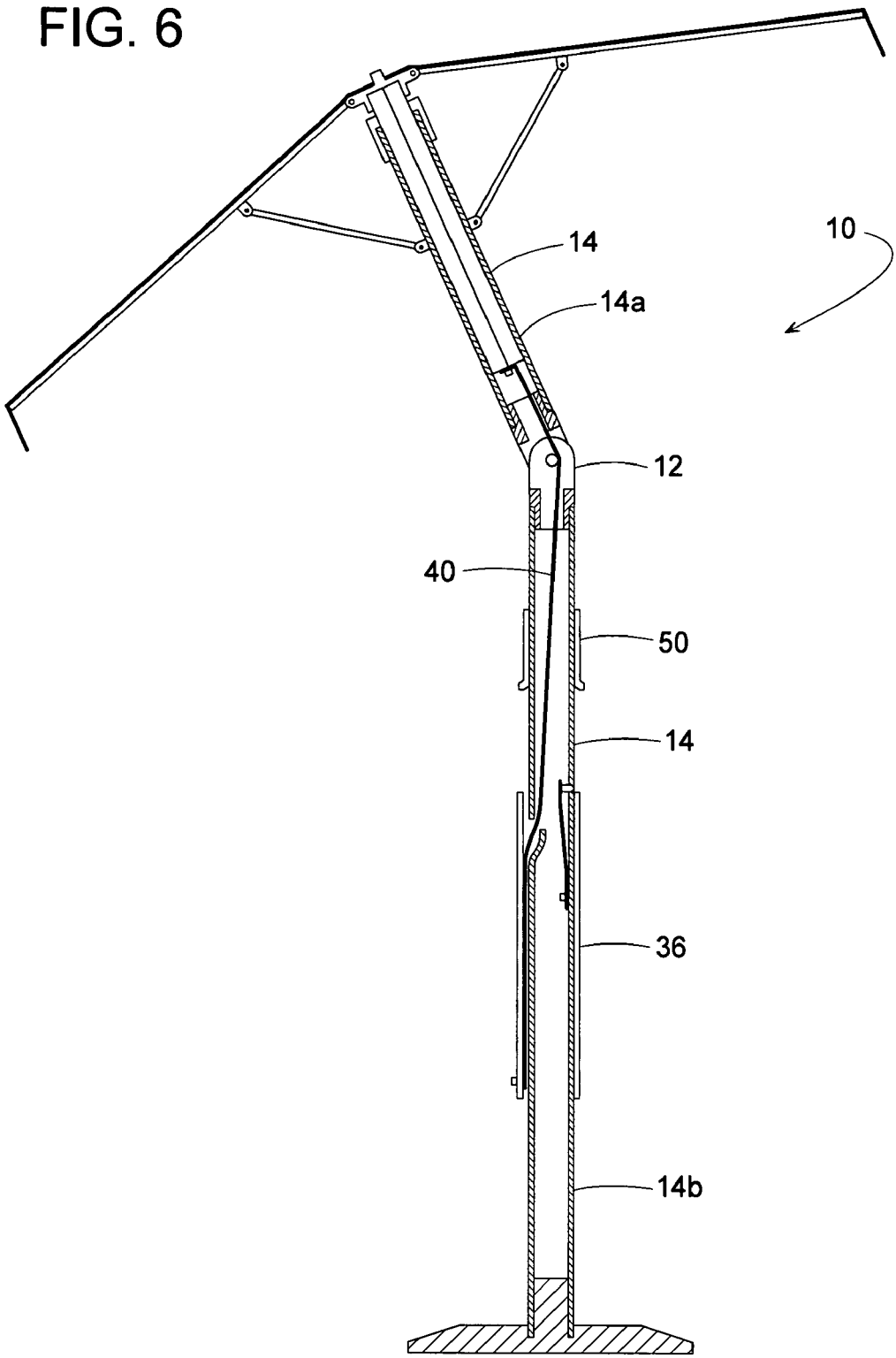
FIG. 6 is a cross-sectional view of the umbrella in a tilted position.

FIGS. 1-6 show an umbrella 10 that can be selectively configured to an open position (FIGS. 1, 3, 4 and 6) and a closed position (FIG. 2). FIG. 5 shows umbrella 10 partway between its fully open and closed positions. Although umbrella 10 is shown with a hinge 12 for tilting umbrella 10, as shown in FIG. 6, the subject invention also applies to non-tilting umbrellas without a hinge.

In some embodiments of the invention, umbrella 10 comprises a tubular mast 14 attached to a base 16. Mast 14 has an interior 18, an exterior 20, and a sidewall aperture 22. If umbrella 10 includes hinge 12, then mast 14 comprises an upper tube 14*a* and a lower tube 14*b* that are pivotally coupled to each other via hinge 12; otherwise, tubes 14*a* and 14*b* could be a unitary mast piece or rigidly interconnected. A shaft 24 telescopically coupled to mast 14 protrudes upward from upper tube 14*a* and can slide vertically relative to tube 14*a*. A series of ribs 26 supporting a fabric canopy 28 are pivotally attached at a central hub 27 near the upper end of shaft 24. To support ribs 26, a series of spokes 30 are pivotally connected at a generally fixed point 32 on mast 14 and are also pivotally connected to an intermediate point 34 along each rib 26.

To enable a user to manually open and close umbrella 10, a cylindrical actuator sleeve 36 that can be manually gripped is slidingly disposed on the exterior of mast 14. Connected to sleeve 36 at a point 38 is a resiliently flexible and substantially incompressible elongate member 40 that extends from point 38 on sleeve 36, extends through sidewall aperture 22, through lower tube 14*b*, through hinge 12 (in the case of tiltable umbrellas), through upper tube 14*a*, and attaches to shaft 24 at a point 42. Thus, elongate member 40 couples sleeve 36 to shaft 24 so that sleeve 36 and shaft 24 move generally in unison relative to mast 14.

In a currently preferred embodiment, elongate member 40 is a spring steel band such as those commonly used by electricians to snake wires through conduit. The steel band can be 0.2" wide by 0.025" thick, wherein the drawing figures display the band's thickness. Such a band proves to be ideal in that its 0.025" thickness enables the band to flex through aperture 22 and snake through hinge 12, the band has sufficient stiffness to transmit an upward pushing force from sleeve 36 to shaft 24 to close umbrella 10, and the band has sufficient tensile strength to pull shaft 24 downward to open the umbrella.

Aperture 22 can be a simple round hole or be of some shape sized to freely receive elongate member 40. In some cases, aperture 22 includes a formed lead-in 44 that helps smoothly guide elongate member 40 through aperture 22. To prevent canopy 28 from twirling and thus twisting elongate member 40, umbrella 10 can be provided with an anti-rotation feature. In some embodiments, for instance, the cross-section of shaft 24 is octagonal, square or some shape other than round, and that shape slidingly fits within an anti-rotation collar 43 having a mating shaft-receiving opening, thereby preventing relative rotation between shaft 24 and upper tube 14*a*.

Figure 3:
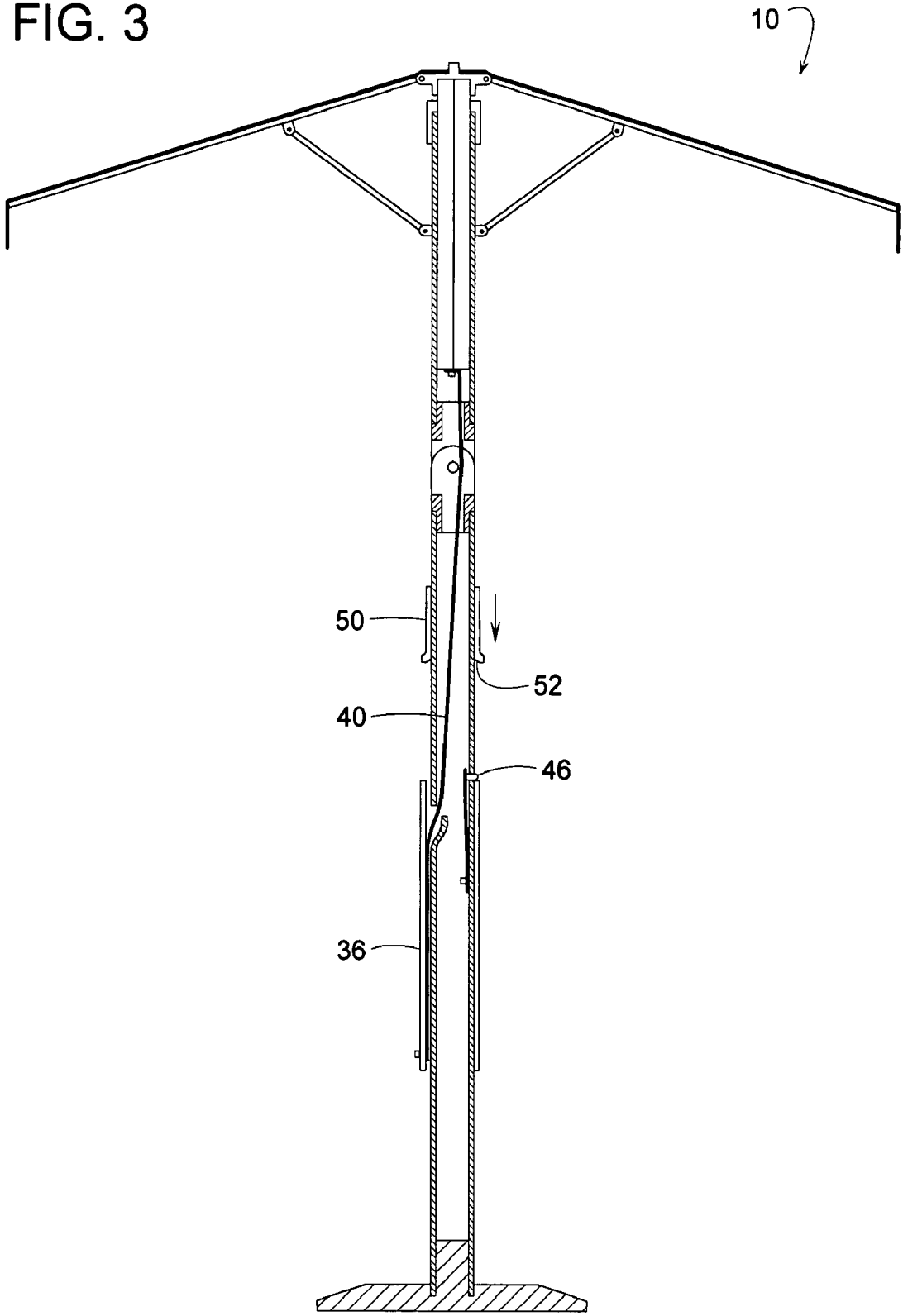
FIG. 3 is another cross-sectional side view of the umbrella.
Figure 4:
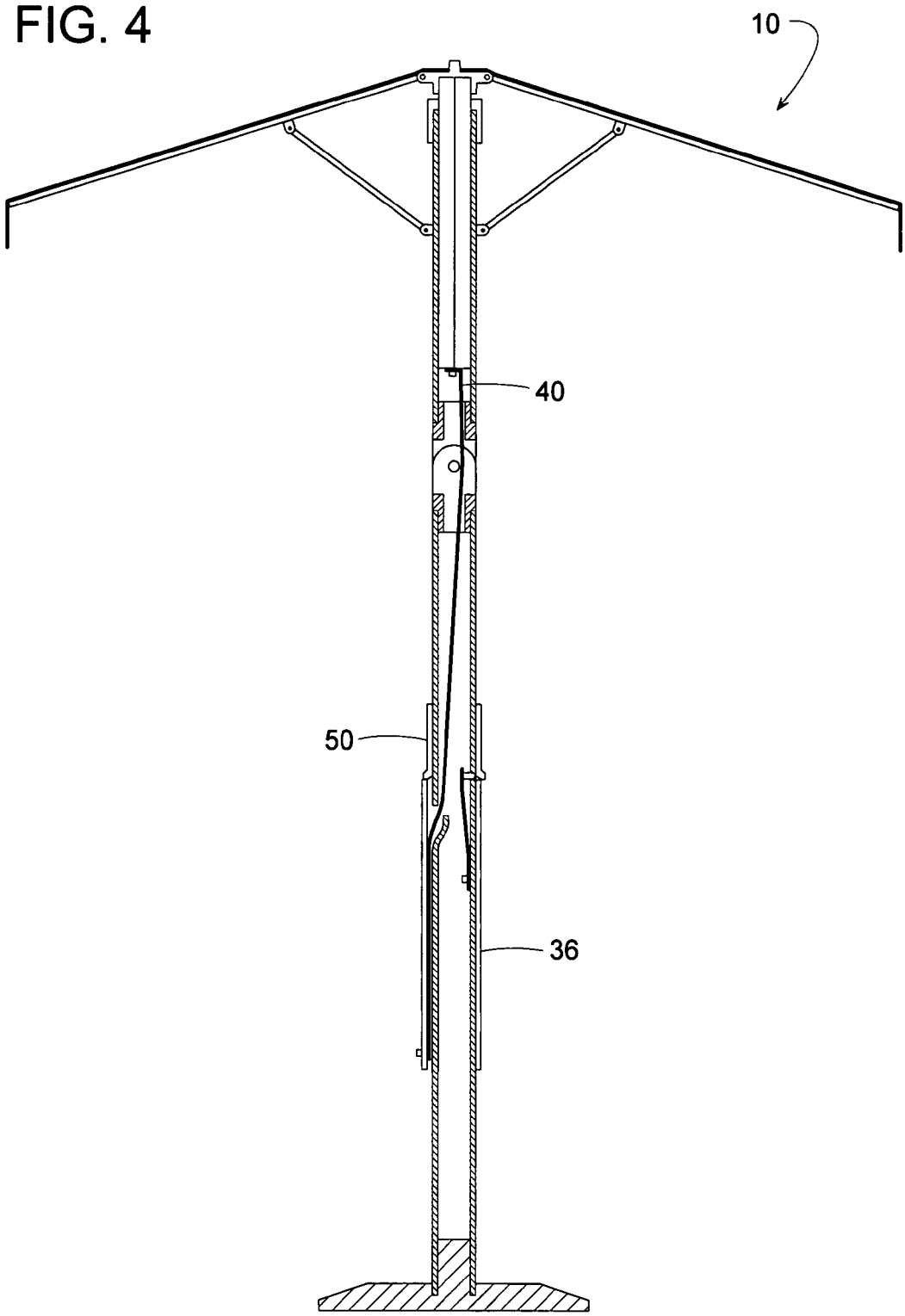
FIG. 4 is a cross-sectional side view of the umbrella fully open but about to be closing.

To help hold canopy 28 in its open position, umbrella 10 can be provided with a spring loaded retractable button 46 on mast 14. Retractable button 46 is selectively movable to an extended position (FIG. 3) and a retracted position (FIG. 4), wherein a leaf spring 48 urges button 46 to its extended position. Button 46 helps hold umbrella 10 in the open position by catching the upper edge of sleeve 36, as shown in FIG. 3. Retracting button 46 within mast 14 allows sleeve 36 to slide up and over button 46 to raise shaft 24 and close umbrella 10, as shown in FIG. 5. Button 46 can be retracted by simply pushing the button in manually with a finger, or a button-release sleeve 50 can be used to make this easier to do. Specifically, button-release sleeve 50 can be manually slid downward from the position of FIG. 3 to that of FIG. 4, whereby a beveled cam surface 52 on button-release sleeve 50 pushes button 46 inward to release actuator sleeve 36.

When umbrella 10 is fully open, as shown in FIG. 3, the weight of canopy 28 applies tension to elongate member 40, which urges sleeve 36 tightly up against extended button 46.

To subsequently close the umbrella, button-release sleeve 50 is slid down over button 46 to release actuator sleeve 36. Once button 46 is retracted, the initial tension in elongate member 40 immediately pulls actuator sleeve upward to an intermediate point of equilibrium shown in FIG. 5. This movement, which begins closing umbrella 10, continues until the umbrella's vertical center of gravity and friction demand additional external force to move umbrella 10 from its intermediate point of equilibrium of FIG. 5 to its fully closed position of FIG. 2. This external force is provided by a user manually sliding actuator sleeve 36 upward from its position of FIG. 5 to that of FIG. 2. The user forcibly lifting actuator sleeve 36 places elongate member 40 in compression, whereby elongate member 40 actually pushes shaft 24 upward from the position of FIG. 5 to that of FIG. 2.

FIG. 6 illustrates how the umbrella's actuating mechanism can accommodate an umbrella that can tilt at hinge 12. Hinge 12 itself is an element commonly found on patio umbrellas, thus the design details of such a hinge is well known to those of ordinary skill in the art.

Although the invention is described with respect to a preferred embodiment, modifications thereto will be apparent to those of ordinary skill in the art. The scope of the invention, therefore, is to be determined by reference to the following claims.

The invention claimed is:

1. An umbrella selectively configurable to an open position and a closed position, the umbrella comprising:

a tubular mast having an interior and an exterior, the tubular mast defines a sidewall aperture;

a shaft telescopically coupled to the tubular mast;

a plurality of ribs pivotally coupled to the shaft;

a plurality of spokes pivotally coupled to the tubular mast and pivotally coupled to the plurality of ribs;

a canopy supported by the plurality of ribs;

an actuator sleeve slidingly disposed on the exterior of the tubular mast; and an elongate member that is resiliently flexible and substantially incompressible, the elongate member extends through the sidewall aperture and couples the actuator sleeve to the shaft such that:

a) in response to the actuator sleeve being slid upward along the tubular mast, the elongate member feeds further into the interior of the tubular mast and pushes the shaft upward to move the umbrella to the closed position; and b) in response to the actuator sleeve being slid downward along the tubular mast, the elongate member retracts from within the interior of the tubular mast and pulls the shaft downward to move the umbrella to the open position, thus more of the elongate member is within the interior of the tubular mast when the umbrella is in the closed position than when the umbrella is in the open position.

2. The umbrella of claim 1, wherein the elongate member comprises a metal band.

3. The umbrella of claim 1, wherein the tubular mast comprises an upper tube, a lower tube and a hinge that pivotally couples the upper tube to the lower tube.

4. The umbrella of claim 3, wherein the actuator sleeve encircles the lower tube.

5. The umbrella of claim 3, wherein the elongate member extends through both the lower tube and the upper tube.

6. The umbrella of claim 3, wherein the elongate member extends through the hinge.

7. The umbrella of claim 1 further comprising a retractable button on the tubular mast, the retractable button is selectively movable to an extended position and a retracted position, the retractable button helps hold the umbrella in the open position when the retractable button is in the extended position and engaging the actuator sleeve, the retractable button allows the actuator sleeve to slide upward and over the retractable button when the retractable button is in the retracted position, and further comprising a button-release sleeve slidingly disposed on the mast above the actuator sleeve, the button-release sleeve includes a cam surface that can engage the retractable button such that when the button-release sleeve is slid against the retractable button, the cam surface urges the retractable button to the retracted position.

8. An umbrella selectively configurable to an open position and a closed position, the umbrella comprising:

a tubular mast having an interior and an exterior, the tubular mast defines a sidewall aperture, the tubular mast comprises an upper tube, a lower tube and a hinge that pivotally couples the upper tube to the lower tube;

a shaft telescopically coupled to the upper tube;

a plurality of ribs pivotally coupled to the shaft;

a plurality of spokes pivotally coupled to the upper tube and pivotally coupled to the plurality of ribs;

a canopy supported by the plurality of ribs;

an actuator sleeve slidingly disposed on the exterior of the tubular mast; and an elongate member extending vertically between the actuator sleeve and the exterior of the tubular mast and being resiliently flexible and substantially incompressible, the elongate member extends through the sidewall aperture, through the lower tube, through the hinge and through the upper tube, the elongate member couples the actuator sleeve to the shaft such that:

a) in response to the actuator sleeve sliding upward along the tubular mast, the elongate member pushes the shaft upward to move the umbrella to the closed position; and b) in response to the actuator sleeve sliding downward along the tubular mast, the elongate member pulls the shaft downward to move the umbrella to the open position.

9. The umbrella of claim 8, wherein the elongate member comprises a metal band.

10. The umbrella of claim 8 further comprising a retractable button on the tubular mast, the retractable button is selectively movable to an extended position and a retracted position, the retractable button helps hold the umbrella in the open position when the retractable button is in the extended position and engaging the actuator sleeve, the retractable button allows the actuator sleeve to slide upward and over the retractable button when the retractable button is in the retracted position, and further comprising a button-release sleeve slidingly disposed on the mast above the actuator sleeve, the button-release sleeve includes a cam surface that can engage the retractable button such that when the button-release sleeve is slid against the retractable button, the cam surface urges the retractable button to the retracted position.

11. An umbrella selectively configurable to an open position and a closed position, the umbrella comprising:

a tubular mast having an interior and an exterior, the tubular mast defines a sidewall aperture, the tubular mast comprises an upper tube, a lower tube and a hinge that pivotally couples the upper tube to the lower tube;

a shaft telescopically coupled to the upper tube;

a plurality of ribs pivotally coupled to the shaft;

a plurality of spokes pivotally coupled to the upper tube and pivotally coupled to the plurality of ribs;

a canopy supported by the plurality of ribs;

an actuator sleeve slidingly disposed on the exterior of the tubular mast;

a retractable button on the tubular mast, the retractable button is selectively movable to an extended position and a retracted position, the retractable button helps hold the umbrella in the open position when the retractable button is in the extended position and engaging the actuator sleeve, the retractable button allows the actuator sleeve to slide upward and over the retractable button when the retractable button is in the retracted position;

a button-release sleeve slidingly disposed on the mast above the actuator sleeve, the button-release sleeve includes a cam surface that can engage the retractable button such that when the button-release sleeve is slid against the retractable button, the cam surface urges the retractable button to the retracted position; and a metal band extending vertically between the actuator sleeve and the exterior of the tubular mast and being resiliently flexible and substantially incompressible, the metal band extends through the sidewall aperture, through the lower tube, through the hinge and through the upper tube, the metal band couples the actuator sleeve to the shaft such that:

a) in response to the actuator sleeve sliding upward along the tubular mast, the metal band pushes the shaft upward to move the umbrella to the closed position;

b) in response to the actuator sleeve sliding downward along the tubular mast, the metal band pulls the shaft downward to move the umbrella to the open position; and c) more of the elongate member is within the interior of the tubular mast when the umbrella is in the closed position than when the umbrella is in the open position.

* * * * *